US009248991B2

(12) United States Patent
Peters et al.

(10) Patent No.: US 9,248,991 B2
(45) Date of Patent: Feb. 2, 2016

(54) MEDIA TRANSPORT MODULE

(75) Inventors: Ken Peters, Dundee (GB); Gordon Burke, Angus (GB); Michael Rennie, Fife (GB)

(73) Assignee: NCR CORPORATION, Duluth, GA (US)

( * ) Notice: Subject to any disclaimer, the term of this patent is extended or adjusted under 35 U.S.C. 154(b) by 610 days.

(21) Appl. No.: 12/976,596

(22) Filed: Dec. 22, 2010

(65) Prior Publication Data

US 2012/0161389 A1 Jun. 28, 2012

(51) Int. Cl.

| | |
|---|---|
| ***G07F 7/04*** | (2006.01) |
| ***B65H 31/30*** | (2006.01) |
| ***B65H 29/60*** | (2006.01) |
| ***G07F 19/00*** | (2006.01) |
| ***G07D 11/00*** | (2006.01) |

(52) U.S. Cl.

CPC ..... *B65H 31/3063* (2013.01); *B65H 29/60* (2013.01); *G07D 11/0018* (2013.01); *G07F 19/202* (2013.01); *B65H 2403/21* (2013.01); *B65H 2403/512* (2013.01); *B65H 2404/693* (2013.01); *B65H 2408/13* (2013.01); *B65H 2511/10* (2013.01); *B65H 2511/152* (2013.01); *B65H 2511/222* (2013.01); *B65H 2701/1912* (2013.01)

(58) Field of Classification Search

CPC ..... B65H 31/3063; B65H 29/60; B65H 2403/21; B65H 2403/512; B65H 2404/693; B65H 2408/13; B65H 2511/10; B65H 2511/152; B65H 2511/222; B65H 2701/1912; G07F 19/202; G07D 11/0018

USPC ..... 194/206, 207; 209/534; 382/135; 235/379; 414/788, 789.5, 790, 790.2

See application file for complete search history.

(56) References Cited

U.S. PATENT DOCUMENTS

| | | | | |
|---|---|---|---|---|
| 4,462,509 | A * | 7/1984 | Adelberger | 221/259 |
| 7,464,928 | B2 * | 12/2008 | Ko | 271/187 |
| 7,624,977 | B2 * | 12/2009 | Lee et al. | 271/3.01 |
| 8,261,903 | B2 * | 9/2012 | Deas et al. | 194/344 |
| 2004/0079683 | A1 * | 4/2004 | Utz et al. | 209/534 |
| 2005/0189693 | A1 * | 9/2005 | Ko | 271/9.02 |
| 2006/0012114 | A1 * | 1/2006 | Ko | 271/315 |
| 2006/0076213 | A1 * | 4/2006 | Sekiguchi et al. | 194/206 |
| 2007/0034683 | A1 * | 2/2007 | Eastman et al. | 235/379 |
| 2007/0221469 | A1 * | 9/2007 | Katou et al. | 194/206 |
| 2008/0156613 | A1 * | 7/2008 | Park et al. | 194/206 |
| 2009/0160127 | A1 * | 6/2009 | Kong et al. | 271/264 |
| 2009/0166957 | A1 * | 7/2009 | Kong et al. | 271/198 |

* cited by examiner

*Primary Examiner* — Jeffrey Shapiro

(74) *Attorney, Agent, or Firm* — Schwegman, Lundberg, Woessner

(57) ABSTRACT

A media transport module comprising: a transport extending from a pick coupling area to a stacking port; and a retractable guide. The retractable guide is moveable to extend beyond the stacking port when media items are being stacked and thereby guide media items ejected from the stacking port onto a carriage plate. The retractable guide is also moveable to retract to the stacking port when media items have been stacked so that the carriage plate can close without touching the retractable guide.

15 Claims, 5 Drawing Sheets

MEDIA TRANSPORT MODULE

FIELD OF INVENTION

The present invention relates to improvements in or relating to a media transport module. In particular, though not exclusively, the invention relates to a ballistic stacking media transport module.

BACKGROUND OF INVENTION

A media transport module may be used as part of a media dispenser. One type of media transport module is a media presenter. A media presenter is that part of the dispenser that receives media items from one or more pick units, stacks the received media items into a neat bunch (or stack), and then presents the bunch of media items to a customer.

A ballistic stacking media transport module creates a bunch of media items by ejecting the media items onto a stacking plate. The stacking plate may be located within a shuttle (or carriage) that is moved from a stacking position to a customer presenting position.

One problem associated with ballistic stacking modules that create a stack of media items in a shuttle is that the stack may skew or splay when the shuttle is moved to the customer presenting position. This problem has been addressed by having a clamp within the shuttle that interlaces with a slotted floor or slotted ceiling on the shuttle to clamp the bunch in place while it is being transported. This has the disadvantage that the shuttle becomes bigger (taller) because of the integral clamp. A further problem is that the slots in the floor or ceiling reduce the ability of the shuttle to control the media items across their entire length and width.

SUMMARY OF INVENTION

Accordingly, the invention generally provides methods, systems, and apparatus for an improved media transport module having a retractable guide that extends towards a shuttle during media stacking and retracts once media stacking is complete.

In addition to the Summary of Invention provided above and the subject matter disclosed below in the Detailed Description, the following paragraphs of this section are intended to provide further basis for alternative claim language for possible use during prosecution of this application, if required. If this application is granted, some aspects may relate to claims added during prosecution of this application, other aspects may relate to claims deleted during prosecution, other aspects may relate to subject matter never claimed. Furthermore, the various aspects detailed hereinafter are independent of each other, except where stated otherwise. Any claim corresponding to one aspect should not be construed as incorporating any element or feature of the other aspects unless explicitly stated in that claim.

According to a first aspect there is provided a media transport module comprising:

a transport extending from a pick coupling area to a stacking port; and a retractable guide moveable (a) to extend beyond the stacking port when media items are being stacked and thereby guide media items ejected from the stacking port onto a carriage plate, and (b) to retract to the stacking port when media items have been stacked so that the carriage plate can close without touching the retractable guide.

The retractable guide may comprise: a support portion defining a support axis, and a plurality of fingers extending from the support portion transverse to the support axis.

The plurality of fingers may be mutually parallel.

The support portion may define a belt mount at each of two opposing ends thereof.

The media transport module may further comprise a pair of endless belts mounted on pulleys, and extending between a shaft and a spindle. The belts may have a toothed inner surface, and the pulleys may also be toothed to reduce slippage between the belts and the pulleys.

Each belt mount may include a toothed surface for engaging with complementary teeth on the belts, so that when the belts move, each belt mount (and therefore the entire retractable guide) also moves in the same direction as the belts.

Each belt mount may also define a slot in which a support bar is located to support the retractable guide as the retractable guide is moved by the belts.

The transport may comprise: an upward transport extending from a pick coupling area to a diversion area and operable to route individual media items from the pick coupling area to the diversion area; a divert transport extending from the diversion area to a diverter port; and a stacking transport extending from the diversion area to a stacking port.

The media transport module may further comprise a diverter located at the diversion area and operable, in response to a signal received from a media thickness sensor, to route media items to either (i) the divert transport, or (ii) the stacking transport.

The media transport module may further comprise a chassis defining skid plates forming part of the upward transport, the divert transport, and/or the stacking transport.

The upward transport may further comprise one or more endless belts and/or one or more rollers, and/or any other convenient component of a media transport.

Similarly, the stacking transport may further comprise one or more endless belts and/or one or more rollers and/or any other convenient component of a media transport.

The upward transport and the stacking transport may comprise portions of a single integral transport, or separate transports that can be mutually coupled.

The divert transport may comprise a plurality of endless belts co-operating with one or more skid guides to transport one or more media items therebetween.

The divert transport may comprise a plurality of endless belts co-operating with one or more rollers mounted on one or more skid plates to transport one or more media items between the belts and the rollers.

The divert transport may comprise a plurality of rollers co-operating with one or more skid plates to transport one or more media items therebetween.

The divert transport may comprise a set of rollers on one side of the divert transport co-operating with another set of rollers on the opposite side of the divert transport to transport one or more media items therebetween.

The media transport module may include a media thickness sensor. Alternatively, the media transport module may receive a signal from a media thickness sensor external to the media transport module.

The media transport module may include a media width sensor operable to detect the width of a media item being transported. The media width sensor may also be operable to detect any skew of a transported media item, or any long or wide media item.

The diverter may be operated by a solenoid powered via an electrical connector.

The chassis may include one or more physical presenter couplings (such as screw-threaded apertures) for connecting the media transport module to a presenter module.

The chassis may include one or more physical pick couplings (such as clasps) for connecting the media transport module to a pick unit.

The media transport module may comprise a banknote transport module.

The media transport module may further comprise a dedicated drive mechanism coupled to the retractable guide, and a control board coupled to the dedicated drive mechanism. The control board may be operable (i) to extend the retractable guide by activating the drive mechanism in one direction, and (ii) to retract the retractable guide by activating the drive mechanism in the opposite direction. The control board may also be operable to extend the retractable guide to a plurality of different positions, the position selected being dependent on the size of the media items being stacked. Since the control board can control how far the retractable guide extends (up to its maximum extension), it is possible to vary the amount of the extension based on the size of the media item being stacked, the size (height) of the stack, or any other relevant criterion.

According to a second aspect there is provided a media presenter comprising a media transport module according to the first aspect.

The media presenter may further comprise a purge container. The purge container may comprise a first compartment including a slot aligned with the diverter port to receive media items ejected therethrough.

The media items may comprise banknotes, tickets, coupons, or the like.

According to a third aspect there is provided a media dispenser comprising one or more pick units coupled to the media presenter according to the second aspect.

According to a fourth aspect there is provided a self-service terminal incorporating the media dispenser of the third aspect. The self-service terminal may be an automated teller machine, an information kiosk, a financial services centre, a bill payment kiosk, a lottery kiosk, a postal services machine, a check-in and/or check-out terminal such as those used in the retail, hotel, car rental, gaming, healthcare, and airline industries, or the like.

The word "media" is used herein in a generic sense to denote one or more items, documents, or such like, in sheet form; in particular, the word "media" when used herein does not necessarily relate exclusively to multiple items or documents. Thus, the word "media" may be used to refer to a single item (rather than using the word "medium"), multiple items, and/or an indeterminate (or currently undetermined) number of items (either one or more). For example, a transport may receive media which is transported as a single item, but when tested by a media thickness sensor may actually comprise two media items superimposed and transported as if they were a single item.

According to a fifth aspect there is provided a method of stacking media items in a carriage, the method comprising:

advancing a retractable guide so that part of the retractable guide extends beyond a stacking port to assist stacking of media items;

receiving individual media items from a pick unit;

ejecting the received individual media items through the stacking port to create a stack of media items;

retracting the retractable guide so that substantially all of the retractable guide is behind the stacking port when the stack of media items has been created.

According to a sixth aspect there is provided a controller programmed to implement the steps of the fifth aspect.

For clarity and simplicity of description, not all combinations of elements provided in the aspects recited above have been set forth expressly. Notwithstanding this, the skilled person will directly and unambiguously recognise that unless it is not technically possible, or it is explicitly stated to the contrary, the consistory clauses referring to one aspect are intended to apply mutatis mutandis as optional features of every other aspect to which those consistory clauses could possibly relate.

These and other aspects will be apparent from the following specific description, given by way of example, with reference to the accompanying drawings.

Figure 1:
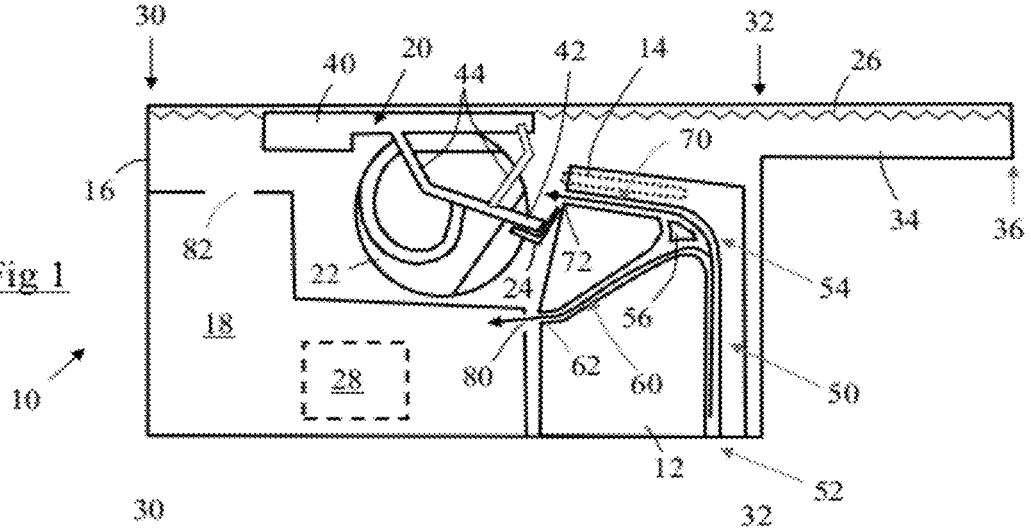
FIG. 1 is a simplified schematic side view of a media presenter including a media transport module incorporating a retractable guide according to one embodiment of the present invention, where the retractable guide is shown in a retracted position.

It should be appreciated that some of the drawings provided are based on computer renderings from which actual physical embodiments can be produced. As such, some of these drawings contain intricate details that are not essential for an understanding of these embodiments but will convey useful information to one of skill in the art. Therefore, not all parts shown in the drawings will be referenced specifically. Furthermore, to aid clarity and to avoid numerous leader lines from cluttering the drawings, not all reference numerals will be shown in all of the drawings. In addition, some of the features are removed from some views to further aid clarity.

DETAILED DESCRIPTION

Reference is first made to FIG. 1, which is a simplified schematic side view of a media presenter 10 including a media transport module 12 incorporating a retractable guide 14 according to one embodiment of the present invention. The media presenter 10 is in the form of a banknote presenter; and the media transport module 12 is in the form of a banknote transport module.

Figure 2:
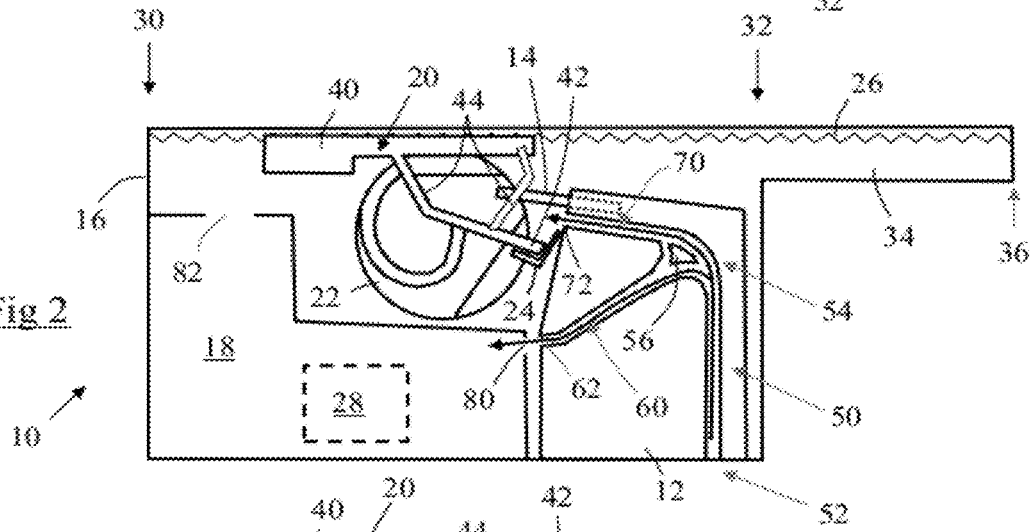
FIG. 2 is a simplified schematic side view of the media presenter of FIG. 1, where the retractable guide is shown in an extended position for guiding media items into a part (a carriage in an open position) of the dispenser.

Reference is also made to FIG. 2, which is a simplified schematic side view of the banknote presenter 10, where the retractable guide 14 is shown in an extended position.

The banknote presenter 10 includes a chassis 16 and further comprises a purge bin 18, a carriage 20 (shown at a filling position in FIG. 1), a cam block 22 for opening and closing the carriage 20 by engaging with a cam follower (not shown) on the carriage 20, a registration device 24 for maintaining banknotes sprayed into the carriage 20 from the banknote transport module 12 as a neat stack, a linear toothed rack 26, and a control board (shown by dotted line 28) for controlling the banknote presenter 10.

Although not described in detail herein, control board 28 is operable to move the carriage 20 (in both forward and reverse directions) along the linear toothed rack 26.

The chassis 16 is formed from sheet metal. The chassis 16 extends from a handle end 30 to a pick end 32, and has a generally cuboid shape. A removable elongated nose 34 is coupled to the chassis 16 at one end and extends from the chassis 16 to a presenting end 36 of the nose 34.

Figure 3:
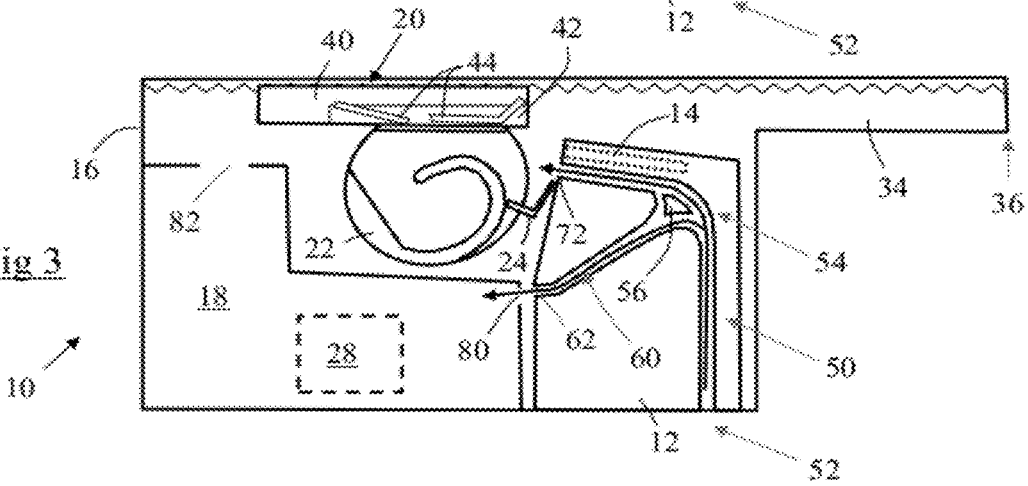
FIG. 3 is a simplified schematic side view of the media presenter of FIG. 1, where the retractable guide is shown in a retracted position, with the carriage in a closed position.

The carriage 20 comprises a carriage body 40 and a carriage plate 42 coupled to the carriage body 40 by a linkage 44. The carriage plate 42 is shown in the open position in FIG. 1. In operation, the carriage plate 42 is moved to the open position and banknotes are loaded onto the carriage plate 42 from the banknote transport module 12 to form a stack on the carriage plate 42. The carriage plate 42 is then closed by rotating the cam block 22 until the carriage plate 42 reaches the closed position, as shown in FIG. 3.

The banknote transport module 12 further comprises: (i) an upward transport 50 extending from a pick coupling area 52 to a diversion area 54, where a pivoting diverter gate 56 is located; (ii) a divert transport 60 extending from the diversion area 54 to a diverter port 62, and (iii) a stacking transport 70 extending from the diversion area 54 to a stacking port 72. This enables the banknote transport module 12 to route a banknote either to the purge bin 18 or to the carriage 20, as illustrated by the two curved arrows in FIG. 1.

The purge bin 18 defines an input slot 80 aligned with the diverter port 62, and a purge slot 82 into which the carriage 20 can deposit a bunch of banknotes.

The retractable guide 14 is located above the stacking transport 70 and can be extended (as shown in FIG. 2) so that it protrudes beyond the stacking port 72 and above part of the carriage plate 42.

Once banknotes have been loaded onto the carriage plate 42 from the banknote transport module 12 (via the upward transport 50 and the stacking transport 70), the retractable guide 14 can be retracted to the position shown in FIGS. 1 and 3 so that the carriage plate 42 can close.

The retractable guide 14 and those parts of the banknote transport module 12 that move the retractable guide 14 will now be described in more detail.

Figure 4:
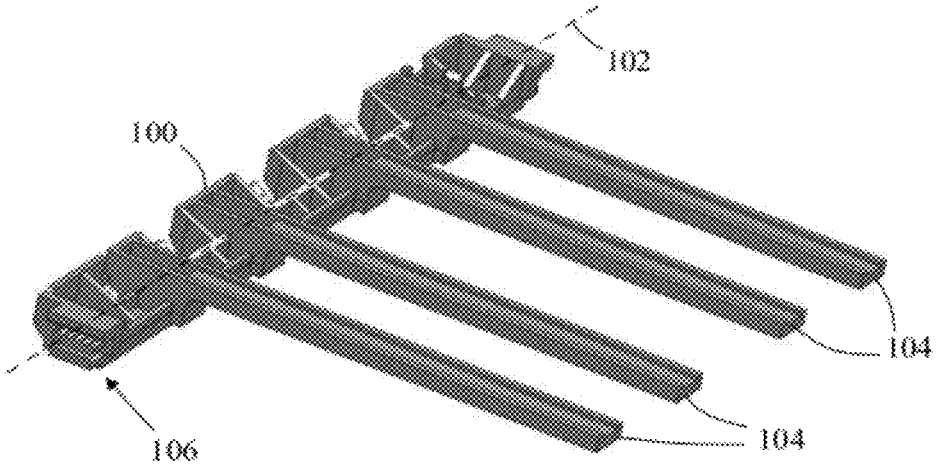
FIG. 4 is a perspective view illustrating the retractable guide of FIGS. 1 to 3.
Figure 5:
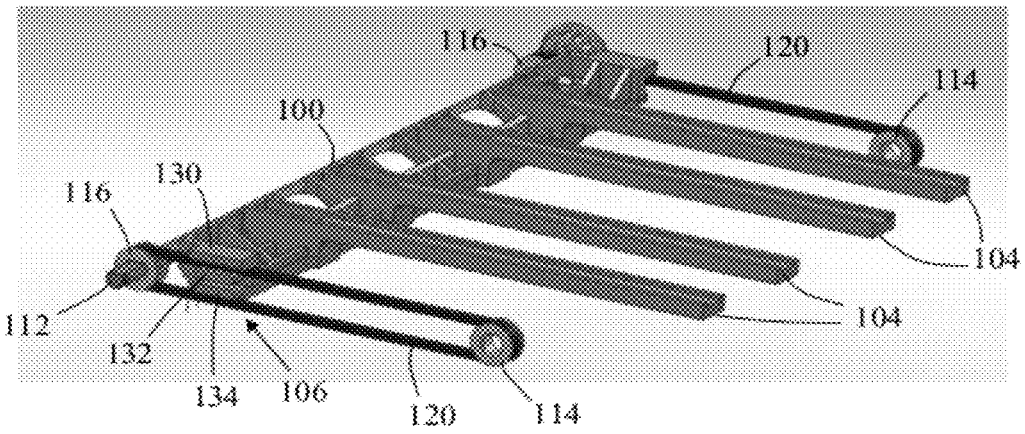
FIG. 5 is a perspective view illustrating the retractable guide of FIGS. 1 to 3 together with some components of the media transport module to illustrate how the retractable guide is moved.

Reference will be made to FIG. 4, which illustrates the retractable guide 14 in more detail.

The retractable guide 14 comprises an elongated support portion 100 defining a support axis 102, and four parallel fingers 104 extending transversely from the support axis 102.

The support portion 100 defines two belt mounts 106; one belt mount 106 at each end of the support portion 100.

Reference will now also be made to FIGS. 5 to 8, which illustrate the retractable guide 14 together with some drive components of the banknote transport module 12.

The banknote transport module 12 includes a shaft 110 located above the stacking port 72 and a spindle 112 located generally above the diversion area 54. Toothed idler pulleys 114 are mounted on opposite ends of the shaft 110 and are free to rotate about the shaft 110 so that the toothed idler pulleys 114 rotate relative to the shaft 110. In contrast, toothed pulleys 116 are mounted on, and fixed to, opposite ends of the spindle 112 so that the toothed pulleys 116 rotate with (not relative to) the spindle 112.

Endless belts 120 extend between the idler pulleys 114 and the spindle pulleys 116. The belts 120 have a toothed inner surface matching, and interlocking with, the tooth profile of the toothed pulleys 114,116.

Each belt mount 106 (best seen in FIGS. 6 and 7) comprises an upper guide bracket 130 abutting one side of the belt 120 being guided, and protruding over an outer surface of that belt 120.

Each belt mount 106 further comprises a pair of internal guides 132,134 located between upper and lower portions of the belt 120; that is, located within the internal space defined by the belt 120.

The upper internal guide 132 includes a toothed upper surface 136 having a complementary profile to the profile of the toothed belt 120. The toothed upper surface 136 interlocks with the toothed inner surface of the belt 120.

Figure 6:
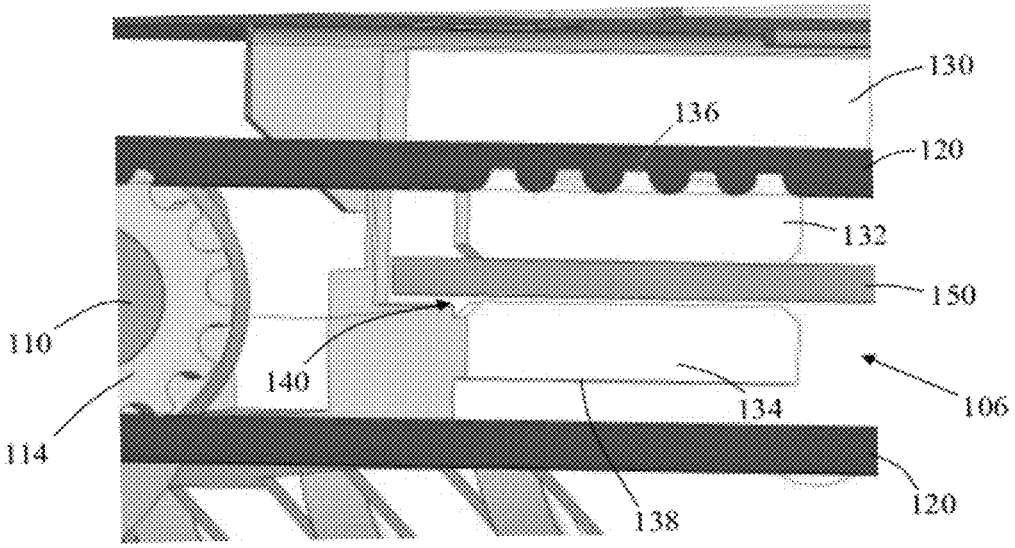
FIG. 6 is perspective view showing part of FIG. 5 in more detail.
Figure 7:
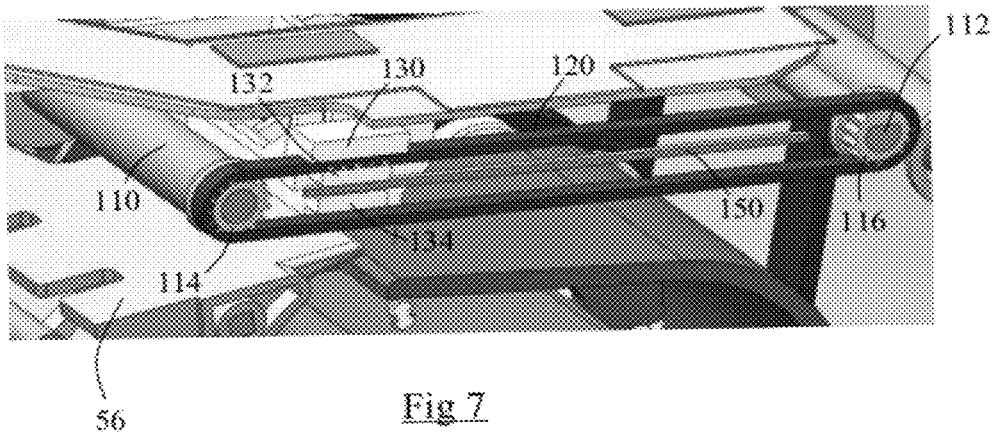
FIG. 7 is an upper perspective view showing the retractable guide mounted within the media transport module of FIG. 1.

The lower internal guide 134 has a smooth lower surface 138 that is spaced from the lower portion of the belt 120 (best seen in FIGS. 6 and 7).

The upper and lower internal guides 132,134 define a slot 140 therebetween. A support bar 150 is mounted in the banknote transport module 12 and is located parallel to the upper and lower portions of the belt 120 so that it passes through the slot 140. This prevents the support portion 100 from skewing as the retractable guide 14 is moved, and also constrains the movement of the support portion 100 to a defined horizontal plane.

Figure 8:
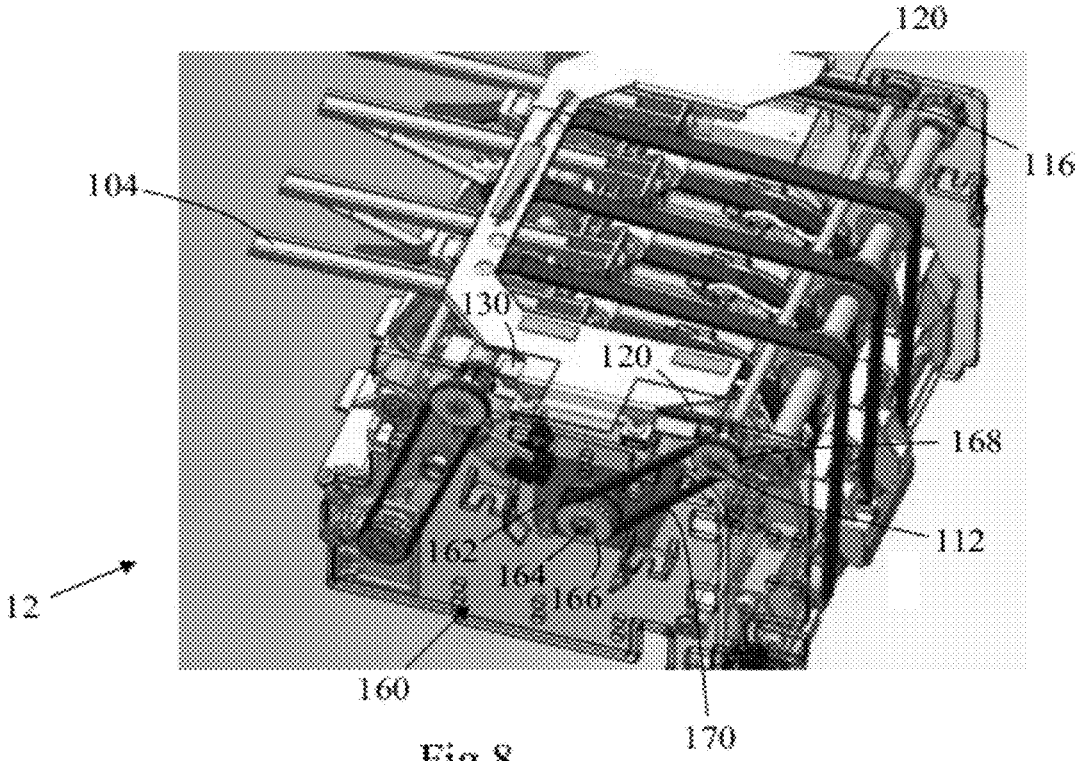
FIG. 8 is a detailed pictorial view of the media transport module of FIG. 1, with the retractable guide in the extended position, and illustrating a drive mechanism for extending and retracting the retractable guide.

Reference will now also be made to FIG. 8, which is a detailed pictorial view of the banknote transport module 12, with the retractable guide 14 in the extended position, and illustrating a drive mechanism 160 for extending and retracting the retractable guide 14. To illustrate the drive mechanism 160 more clearly, a chassis sidewall of the banknote transport module 12 is shown in outline only (that is, it is transparent) in FIG. 8.

The drive mechanism 160 comprises a motor 162 driving a motor spindle 164 on which is mounted a toothed motor pulley 166. The toothed motor pulley 166 is fixed to the motor spindle 164 so that it rotates as the motor spindle 164 rotates.

A toothed drive pulley 168 is fixed to the spindle 112 so that the spindle 112 is rotated by rotation of the toothed drive pulley 168. A drive belt 170 extends between, and is mounted on, the motor pulley 166 and the drive pulley 168. This enables rotation of the motor spindle 164 to impart rotation to the spindle 112.

To extend the retractable guide 14, the control board 28 rotates the motor 162 anticlockwise (from the viewing position of FIG. 8).

Anti-clockwise rotation of the motor spindle 164 imparts anti-clockwise rotation to the spindle 112, which causes the belts 120 to rotate anti-clockwise.

This drives the upper internal guide 132 (and consequently the rest of the retractable guide 14) towards the stacking port 72. This causes the fingers 104 to project beyond the stacking port 72.

Figure 9:
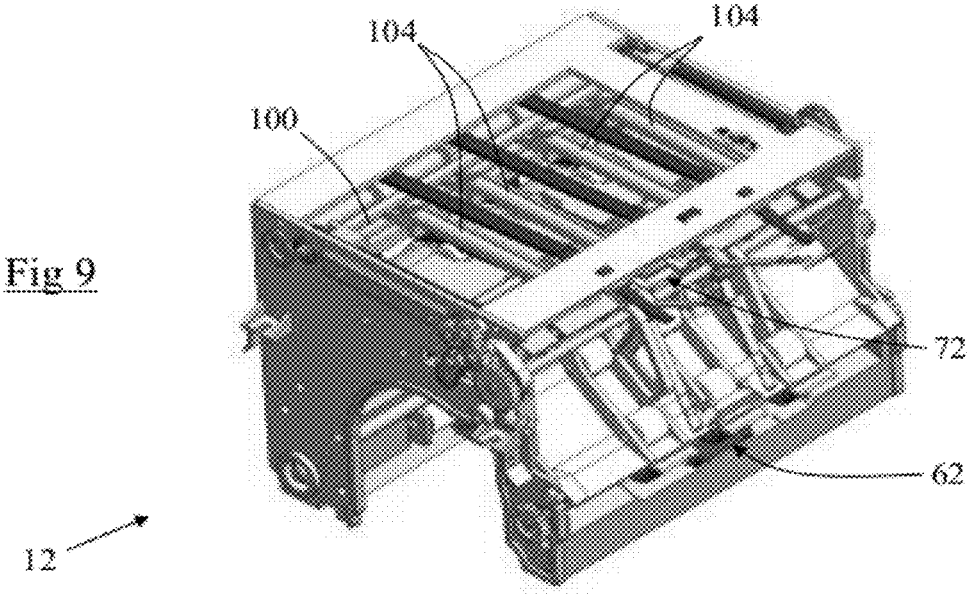
FIG. 9 is a detailed pictorial view of the media transport module of FIG. 1, with the retractable guide in the retracted position.
Figure 10:
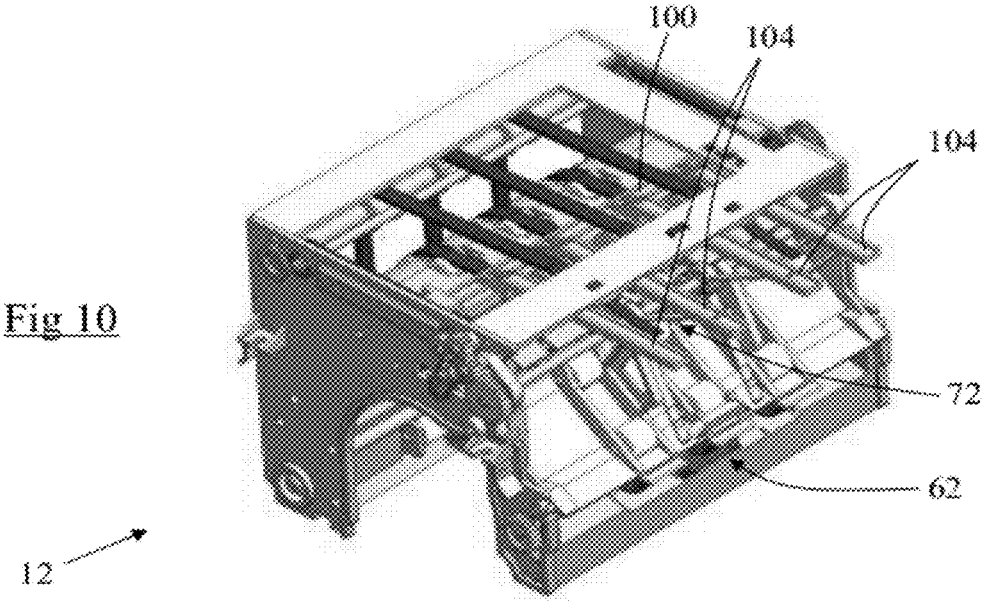
FIG. 10 is a detailed pictorial view of the media transport module of FIG. 1, with the retractable guide in the extended position.

FIG. 9 illustrates the banknote transport module 12 with the retractable guide in its retracted position; whereas, FIG.

10 illustrates the banknote transport module 12 with the retractable guide 14 in its extended (or projected) position.

As banknotes exit the stacking port 72, the extended fingers 104 stop the banknotes from rising too high and guide the banknotes towards the carriage plate 42; thereby improving the quality of the stack of banknotes created on the carriage plate 42.

Once the stack of banknotes has been created, the control board 28 reverses the rotation of the motor 162, so that the motor spindle 164 rotates clockwise. Clockwise rotation of the motor spindle 164 imparts clockwise rotation to the spindle 112, which causes the belts 120 to rotate clockwise.

Clockwise (again, all references to clockwise and anti-clockwise refer to the viewing position of FIG. 8) rotation of the spindle 112 causes the belts 120 to rotate in the clockwise, which drives the upper internal guide 132 (and consequently the rest of the retractable guide 14) away from the stacking port 72 and towards the spindle 112. This causes the fingers 104 to retract from the stacking port 72.

By using a dedicated drive mechanism 160, the retractable guide 14 can be extended by less than its full amount, if desired. This may be advantageous if narrow media items are being stacked.

It should now be appreciated that this embodiment has the advantage that a removable guide (or ceiling) is provided that guides media items (such as banknotes) while they are being stacked, but can be retracted when stacking is complete so that the carriage on which the stack is created can close. This allows a carriage to be designed that does not have to interlace with a guide. Consequently, it allows the carriage to have greater control of the stack of media items because it can clamp the stack over its entire (or most of its) length and width. It also allows a smaller carriage to be used because no retractable ceiling is needed in the carriage.

Various modifications may be made to the above described embodiment within the scope of the present invention. For example, in other embodiments, the media transport module may be used for transporting cheques, tickets, coupons, passes, licenses, or the like.

Different components may be used in the transport sections than those described above, for example, a gear train or skid plates may be used.

In other embodiments, a dedicated drive mechanism may not be used to move the retractable guide; instead, a drive mechanism may be added to one of the existing transports (such as the upward drive mechanism) so that the retractable guide is moved forwards as the upward drive mechanism is activated and the retractable guide is moved backwards when the upward drive mechanism is reversed.

In other embodiments, different carriage designs may be used than that described above.

The steps of the methods described herein may be carried out in any suitable order, or simultaneously where appropriate.

The terms "comprising", "including", "incorporating", and "having" are used herein to recite an open-ended list of one or more elements or steps, not a closed list. When such terms are used, those elements or steps recited in the list are not exclusive of other elements or steps that may be added to the list.

Unless otherwise indicated by the context, the terms "a" and "an" are used herein to denote at least one of the elements, integers, steps, features, operations, or components mentioned thereafter, but do not exclude additional elements, integers, steps, features, operations, or components.

What is claimed is:

1. A media transport module comprising:

a transport extending from a pick coupling area to a stacking port wherein the transport is adapted to eject media items from the stacking port; and a retractable guide linearly moveable (a) to extend beyond the stacking port and over a carriage plate when media items are being stacked and thereby guide media items ejected from the stacking port onto the carriage plate and prevent the closing of the carriage plate, and (b) to retract into the body of the media transport module to a position where the end of the retractable guide is flush with the stacking port when media items have been stacked so that the carriage plate can close without touching the retractable guide, wherein the carriage plate is closed by rotating a cam block until the carriage plate reaches a closed position.

2. A media transport module according to claim 1, wherein the retractable guide comprises: a support portion defining a support axis, and a plurality of fingers extending from the support portion transverse to the support axis.

3. A media transport module according to claim 2, wherein the plurality of fingers are disposed in a mutually parallel arrangement.

4. A media transport module according to claim 2, wherein the support portion defines a belt mount at each of two opposing ends thereof.

5. A media transport module according to claim 1, wherein the media transport module further comprises a pair of endless belts mounted on pulleys, and extending between a shaft and a spindle.

6. A media transport module according to claim 5, wherein the belts have a toothed inner surface, and the pulleys also include a toothed surface complementary to the inner surface, and wherein each belt mount includes a toothed surface for engaging with the toothed inner surface on each belt, so that when the belts move, the belt mounts also move in the same direction as the belts.

7. A media transport module according to claim 6, wherein each belt mount also defines a slot in which a support bar is located to support the retractable guide as the retractable guide is moved by the belts.

8. A media transport module according to claim 1, wherein the transport comprises: an upward transport extending from the pick coupling area to a diversion area and operable to route individual media items from the pick coupling area to the diversion area; a divert transport extending from the diversion area to a diverter port; and a stacking transport extending from the diversion area to the stacking port.

9. A media transport module according to claim 8, wherein the media transport module further comprises a diverter located at the diversion area and operable, in response to a signal received from a media thickness sensor, to route media items to either (i) the divert transport, or (ii) the stacking transport.

10. A media transport module according to claim 9, wherein the media transport module comprises a banknote transport module.

11. A media transport module according to claim 1, wherein the media transport module further comprises a dedicated drive mechanism coupled to the retractable guide, and a control board coupled to the dedicated drive mechanism and operable (i) to extend the retractable guide by activating the drive mechanism in one direction, and (ii) to retract the retractable guide by activating the drive mechanism in the opposite direction, wherein the control board is also operable to extend the retractable guide to a plurality of different positions, the position selected being dependent on the size of the media items being stacked.

12. A media presenter comprising a media transport module according to claim 1.

13. A media dispenser comprising one or more pick units coupled to the media presenter according to claim 12.

14. A self-service terminal incorporating a media dispenser according to claim 13.

15. A method of stacking media items implemented by a media transport module, the method comprising:

linearly advancing a retractable guide from within the body of the media transport module so that part of the retractable guide extends beyond a stacking port to direct stacking of media items;

receiving individual media items from a pick unit;

ejecting the received individual media items through the stacking port to create a stack of media items where the ejected media items contact the extended retractable guide and where the extended retractable guide limits the height the ejected media items reach after they exit the stacking port and guides them to a location where the stack of media items is created; and linearly retracting the retractable guide so that substantially all of the retractable guide is moved behind the stacking port within the body of the media transport module when the stack of media items has been created and closing a carriage plate by rotating a cam block until the carriage plate reaches a closed position.

* * * * *